US005452579A

United States Patent [19]

Friedrichsen

[11] Patent Number: 5,452,579

[45] Date of Patent: Sep. 26, 1995

[54] HYDRAULIC SYSTEM WITH PUMP AND LOAD

[75] Inventor: Welm Friedrichsen, Nordborg, Denmark

[73] Assignee: Danfoss A/S, Nordborg, Denmark

[21] Appl. No.: 170,302

[22] PCT Filed: Jun. 29, 1992

[86] PCT No.: PCT/DK92/00203

§ 371 Date: Dec. 22, 1993

§ 102(e) Date: Dec. 22, 1993

[87] PCT Pub. No.: WO93/01417

PCT Pub. Date: Jan. 21, 1993

[30] Foreign Application Priority Data

Jul. 4, 1991 [DE] Germany ..... 41 22 164.8

[51] Int. Cl.[6] ..... F16D 31/02

[52] U.S. Cl. ..... 60/328; 60/461; 91/1; 91/462

[58] Field of Search ..... 60/328, 422, 451, 60/452, 461; 91/1, 462

[56] References Cited

U.S. PATENT DOCUMENTS 5,138,838 8/1992 Crosser ..... 60/445

5,218,820 6/1993 Sepehri et al. ..... 60/463

*Primary Examiner*—F. Daniel Lopez

*Attorney, Agent, or Firm*—Lee, Mann, Smith, McWilliams, Sweeney & Ohlson

[57] ABSTRACT

A hydraulic system has a pump (1) with at least one load (4, 5) and accompanying bi-directional valves (8, 8*a*). A first comparator (A) establishes which motor line (6, 7) is carrying the higher load pressure. A second comparator (B) establishes whether the input-side motor line (6, 7) allocated a directional signal identifying the direction of the valve displacement is carrying the higher pressure or whether a load (4, 5) is being operated with negative loading. Depending on the result of the comparison, the load pressure signal (y1, y2) can be processed differently.

5 Claims, 2 Drawing Sheets

HYDRAULIC SYSTEM WITH PUMP AND LOAD

The invention is concerned with a hydraulic system with a pump and at least one load, which load is connected by way of two motor lines for input and output of fluid under pressure to a valve operable by a setting device, wherein each motor line is assigned a load pressure-sensing point, a first comparator establishes which motor line is carrying the higher load pressure, and a control means operates in dependence on the higher load pressure and on an associated change-over valve.

Figure 1:
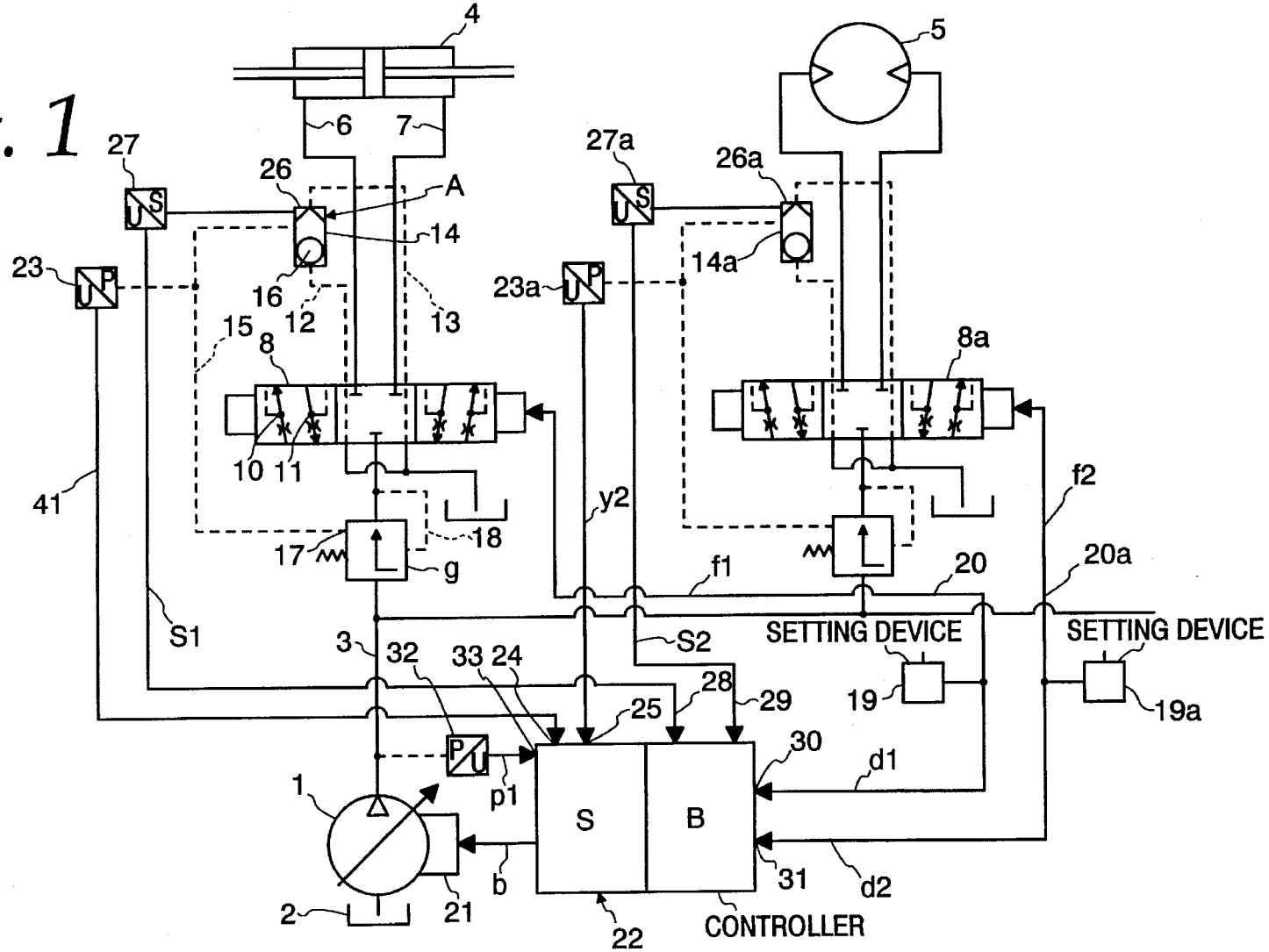

A hydraulic system of that kind is disclosed on page 106, FIG. 1 in the periodical "Öhydraulik und Pneumatik"[1] 34 (1990). A change-over valve serves as the first comparator, with the aid of which the higher load pressure in each case is rendered effective in the load pressure-sensing line. This serves on the one hand for the triggering of a compensating valve, which holds the pressure drop at the proportional valve constant, and on the other hand for an adjustment of the pump so that the pump pressure lies slightly above the highest load pressure of the system. In this manner the load pressure is used directly as the hydraulic pressure signal.

[1] "Oil hydraulics and Pneumatics"

Figure 2:
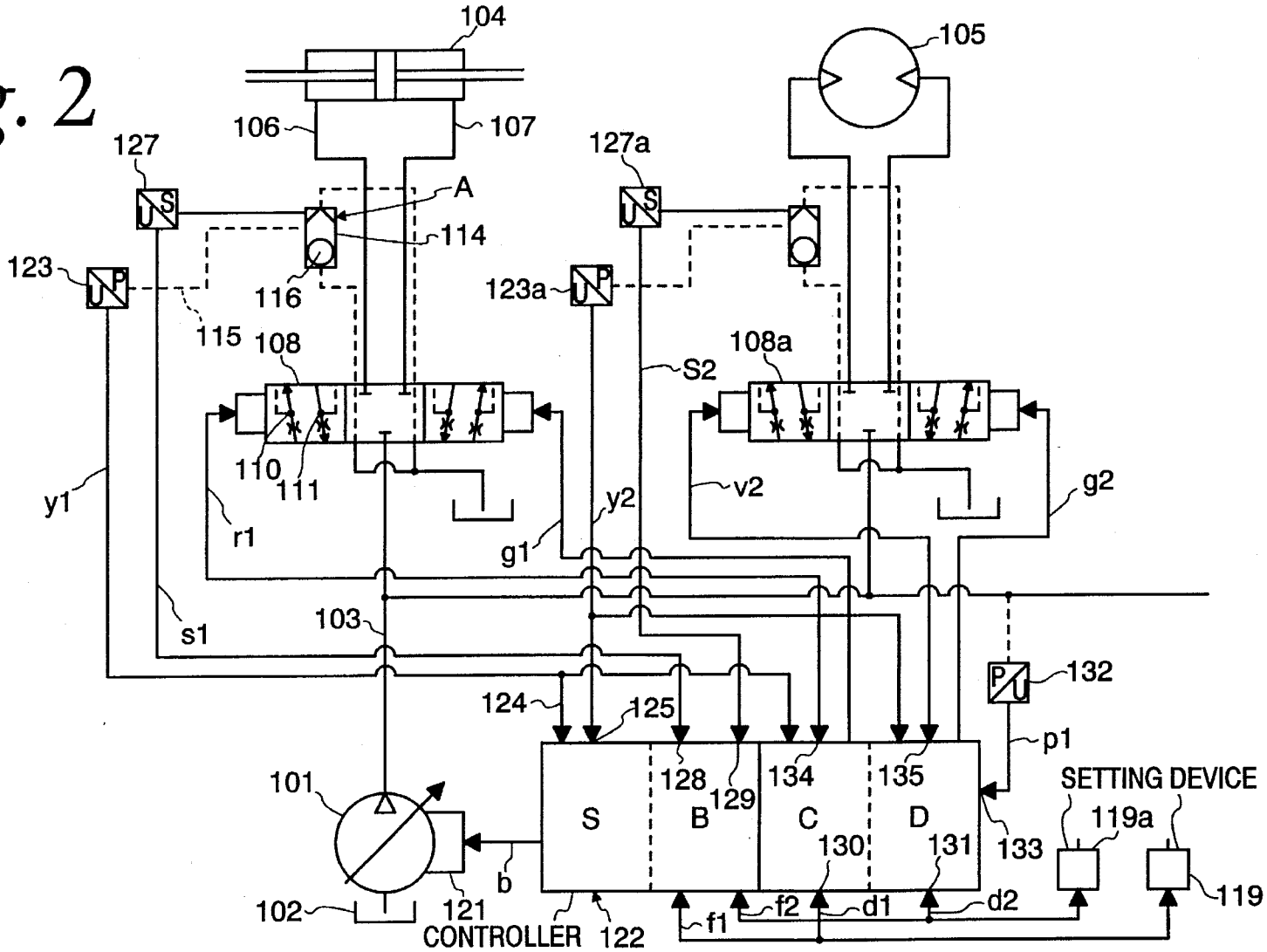

FIG. 2 of the same citation shows that the load pressure and the pump pressure can be converted by pressure-to-voltage converters into electrical load pressure signals and pump pressure signals respectively, and then be further processed digitally. This means that a compensating valve connected upstream of the proportional valve can be omitted, and a valve regulator with characteristics correction can be used in its place inside the control means; this valve regulator determines the correct position of the proportional valve in dependence on pump pressure, load pressure and setting signal. Besides that, the digital control means is able to adjust the delivery state of the pump, taking into account all the requirements of the load.

In both cases there are problems when a load is being operated externally, that is to say, represents a negative loading for the hydraulic system. In that case, the output-side motor line carries the higher load pressure which may lead to malfunctions both at the proportional valve and in the pump delivery.

The invention is based on the problem of providing a hydraulic system of the kind mentioned in the introduction, in which operation with a negative loading can be recognised in a simple manner and therefore be taken into account in the control.

This problem is solved according to the invention in that a pressure-to-voltage converter is provided, which supplies an electrical load pressure signal corresponding to the higher load pressure to the control means, a directional signal identifying the displacement of the valve from the neutral position is arranged to be generated, and the control means includes a second comparator which establishes whether the input-side motor line identified by the directional signal is carrying the higher pressure and processes the load pressure signal in dependence on the result of the comparison.

By operation of the setting device, the valve is displaced from its neutral position in the desired direction. The direction of movement of the load, and thus the input-side motor line, is established in this manner. This is identified by a directional signal. The first comparator ascertains which motor line is carrying the higher load pressure. The result of its comparison and the directional signal therefore enable the second comparator to determine whether the input-side motor line is carrying the higher pressure. When this is the case, then operation is the normal operation with a positive loading, in which the effective load pressure signal is used in the customary manner. If, on the other hand, the second comparator establishes that the output-side motor line is carrying the higher pressure, the detected load pressure must be taken into account in a different way. For example, the valve is reversed. In the case of pump control, the delivery rate can be increased for the same reason, or, if several loads are connected in parallel, the load pressure ascertained in the case of the load operated with negative loading can be left out of consideration. The components additionally needed for recognising the negative loading require only insignificant expenditure.

It is especially advantageous when the control means processes the signals digitally. When such a control means is present anyway, all that is required are slight additions to the operating routines in order to implement the second comparison and to take into account the result of the comparison.

In a preferred embodiment, provision is made for the first comparator to be a change-over valve which connects the two load pressure-sensing points with a common load pressure-sensing line, for the pressure-to-voltage converter to be connected to this load pressure-sensing line, for the change-over valve to have associated with it a position sensor which supplies a position signal identifying the position of the closure member to the control means, and for the second comparator to compare the actual position signal with the position of the closure member to be expected from the directional signal. Because of the changeover valve, one pressure-to-voltage converter is sufficient for the two motor lines. The position sensor, which can be of very simple construction, enables the second comparison to be carried out.

Moreover, it is an advantage for the control means to have for each proportional valve a valve controller with characteristics correction, to which a pump pressure signal corresponding to the pump pressure can be supplied in addition to the load pressure signal. Using the characteristics correction, it is also possible to achieve a proportional action for negative loadings without a compensating valve.

The invention also encompasses a change-over valve for a hydraulic system which is distinguished by a position sensor which establishes whether the closure member has assumed the one end position or not, and supplies a corresponding position signal. Such position sensors can be of very simple construction since they merely have to monitor the presence or absence of the closure member at a specific point. They can operate electrically, magnetically, inductively, optically, mechanically or in any other manner.

The invention is explained in detail hereinafter with reference to preferred embodiments illustrated in the drawing, in which FIG. 1 is the circuit diagram of a first embodiment of a hydraulic system according to the invention, and FIG. 2 shows a modified embodiment.

According to FIG. 1, an adjustable pump 1 conveys fluid under pressure from a tank 2 by way of a pump line 3 to several loads 4 and 5. The load 4 is represented as an axial-piston positioning device and the load 5 as a rotary motor. Each load can be operated in two opposing directions.

For that purpose, the motor lines 6 and 7 of the load 4 are connected to a bi-directional proportional valve 8, which receives fluid under pressure by way of a compensating valve 9. The motor lines 6 and 7 are each assigned a respective one of load pressure-sensing points 10 and 11, which are connected by way of respective connecting lines 12 and 13 and a change-over valve 14 to a common load pressure-sensing line 15. The change-over valve has a closure member 16 which assumes one of its two end positions in dependence on the higher load pressure in each case. This higher load pressure, together with a spring, acts by way of a connection 17 in the closing direction on the piston of the compensating valve 9, whereas the piston is pressurized in the opposite direction by way of a connection 18 by the pressure upstream of the proportional valve 8. The compensating valve 9 therefore holds the pressure drop at the proportional valve 8 constant. The adjustment of the proportional valve 8 is effected by a setting device 19, for example, a hand lever, which supplies an electrical setting signal f1 to the proportional valve 8 by way of a control line 20.

Similarly, the load 5 is provided with a bi-directional proportional valve 8*a*, to which setting signals f2 are supplied from a setting device 19*a* by way of a control line 20*a*.

The pump 1 has a positioning device 21 which is supplied with a control signal b from the control part S of a control means 22. This signal is selected so that the output of the pump just corresponds to the requirement of the load. In order to ascertain this requirement, the respective higher load pressure in the two loads is converted with the aid of a respective pressure-to-voltage converter 23, 23*a* into a respective electrical load pressure signal y1, y2, which is supplied to the inputs 24 and 25 of the control means 22. Furthermore, each change-over valve 14 has a respective position sensor 26 and 26*a* which is connected to a respective position-to-voltage converter 27, 27*a*. These supply a load signal s1, s2 to the inputs 28 and 29 of the control means 22. Furthermore, the setting signals f1 and f2 are fed in the form of directional signals d1 and d2 to the inputs 30 and 31 of the control means 22. Finally, the pump pressure is converted by means of a pressure-to-voltage converter 32 into an electrical pump pressure signal p1 and supplied by way of an input 33 to the control means 22.

In normal operation, the loads operate with positive loading. This means that the pressure in the input-side motor line is higher than in the output-side motor line. In the embodiment illustrated, the position of the closure member 16 of the change-over valve 14 indicates that the motor line 7 is carrying the higher load pressure, and therefore in normal operation, that is, with a positive loading, this line is the input-side motor line. The change-over valve 14 therefore represents a first comparator A which establishes which motor line is carrying the higher load pressure. The result of the comparison is supplied in the form of the load signal s1 to a second comparator B in the control means 22.

The motor line 7 can only be the input-side motor line when the slider of the proportional valve 8 has been pushed to the left on the basis of the corresponding setting signal f1. By comparing the associated directional signal d1 and the position signal s1 it is therefore possible to determine whether the input-side motor line identified by the directional signal is carrying the higher pressure (normal operation). If this is not the case, that is, the higher pressure is on the output-side motor line, then the load 4 operates with negative loading. It is therefore being loaded externally. In that case, the recorded load pressure, which is relayed as a load pressure signal y1 to the control means 22, is processed differently from the way it is processed in normal operation.

In the simplest case, the delivery rate of the pump 1 in normal operation is set so that the pump pressure is slightly above the highest load pressure. The load pressure signals y1 and y2 are therefore compared with one another in the control means 22 in accordance with signals and the pump pressure signal p1 is brought to a value which lies somewhat above the higher of the two load pressure signals. With negative loading, however, the load pressure coming from the output-side motor line is not taken into account in the comparison of the load pressure signals supplied from the individual loads.

In the embodiment according to FIG. 2, reference numerals increased by 100 have been used for corresponding parts. The primary difference is that the bi-directional proportional valves 108, 108*a* receive corrected setting signals g1 and g2 from valve regulators C and D with characteristics correction integrated in the control means 122, and the compensating valves 9 can therefore be omitted. These valve regulators are supplied with the pump pressure signal p1 and the load pressure signal y1, y2 as well as with a return signal r1, r2 identifying the position of the slider of the proportional valve, with the aid of which the setting signals f1, f2 of the setting devices 119, 119*a* are corrected to give a proportional operation. The setting signals g1 and g2 corrected in this manner are then supplied to the proportional valves. The return signals r1 and r2 are relayed to the inputs 134 and 135. The connections 124, 125, 130, 131 are duplicated, which serves merely for clarity, since in practice these connections are internal. Apart from the two valve regulators C and D, the control means 122 contains the comparator B, which operates similarly to that in FIG. 1, and the control part S for adjusting the delivery state of the pump 101.

The control means 122 has digital signal processing. The characteristics corrections are stored. The memory also still takes up those corrections that are desirable when the comparator B establishes that one of the loads is operating with negative loading.

What is claimed is:

1. A hydraulic system with a pump and at least one load, which load is connected by way of two motor lines for input and output of fluid under pressure to a valve operable by a setting device, wherein each motor line is assigned a load pressure-sensing point, a first comparator establishes which motor line is carrying higher load pressure, and a control means operates in dependence on the higher load pressure, characterized in that a pressure-to-voltage converter (23, 23*a*; 123, 123*a*) is provided, which supplies an electrical load pressure signal (y1, y2) corresponding to the higher load pressure to the control means (22; 122), the first comparator being a change-over valve (14, 149; 114) which selectively connects two load pressure-sensing points (10, 11; 110, 111) with a common load pressure-sensing line (15; 115), a directional signal (dl, d2) identifying the displacement of the valve from the neutral position is arranged to be generated, and the control means includes a second comparator (B) which establishes whether an input-side motor line (6, 7; 106, 107) identified by the directional signal is carrying the higher pressure and processes the load pressure signal (y1, y2) in dependence on the result of the comparison.

2. A hydraulic system according to claim 1, characterized in that the control means (22; 122) processes the signals digitally.

3. A hydraulic system according to claim 1, characterized in that the change-over valve has associated with it a position sensor (26; 126) which supplies a position signal (s1, s2) identifying a position of a closure member (16; 116) to the control means (22; 122), and the second comparator (B) compares an actual position signal (s1, s2) with a position of the closure member to be expected from the directional signal (f1, f2).

4. A change-over valve for a hydraulic system according to claim 3, characterized by said position sensor (26) establishing whether the closure member (16) has assumed one end position or not, and supplies a corresponding position signal (s1, s2).

5. A hydraulic system according to claim 1, characterized in that the control means (122) has for each valve (108, 108*a*) a valve controller (C, D) with characteristics correction, to which a pump pressure signal (p1) is supplied in addition to the load pressure signal (y1, y2).

* * * * *